US011293319B2

(12) United States Patent
Kang et al.

(10) Patent No.: US 11,293,319 B2
(45) Date of Patent: Apr. 5, 2022

(54) SYSTEM FOR REGENERATING DPF DURING OPERATION OF ENGINE-POWERED FORKLIFT AND METHOD THEREFOR

(71) Applicant: DOOSAN CORPORATION, Seoul (KR)

(72) Inventors: Hyun Kyu Kang, Gyeonggi-do (KR); Byung Do Choi, Gyeonggi-do (KR); Deok Rae Kim, Seoul (KR); Jun Il Yi, Seoul (KR)

(73) Assignee: DOOSAN CORPORATION, Seoul (KR)

( * ) Notice: Subject to any disclaimer, the term of this patent is extended or adjusted under 35 U.S.C. 154(b) by 136 days.

(21) Appl. No.: 16/474,274

(22) PCT Filed: Dec. 28, 2017

(86) PCT No.: PCT/KR2017/015642
§ 371 (c)(1),
(2) Date: Jun. 27, 2019

(87) PCT Pub. No.: WO2018/124771
PCT Pub. Date: Jul. 5, 2018

(65) Prior Publication Data

US 2020/0123949 A1 Apr. 23, 2020

(30) Foreign Application Priority Data

Dec. 28, 2016 (KR) ..... 10-2016-0181508

(51) Int. Cl.
*F01N 3/00* (2006.01)
*F01N 3/023* (2006.01)
(Continued)

(52) U.S. Cl.
CPC ..... *F01N 3/023* (2013.01); *F01N 9/00* (2013.01); *B66F 9/075* (2013.01)

(58) Field of Classification Search
CPC ..... F01N 3/023; F01N 2590/08; B66F 9/075
(Continued)

(56) References Cited

U.S. PATENT DOCUMENTS

2010/0170227 A1* 7/2010 Tsukada ..... F02D 41/0245 60/286
2011/0000197 A1* 1/2011 Kamiya ..... E02F 9/2246 60/295
(Continued)

FOREIGN PATENT DOCUMENTS

CN 102667081 A 9/2012
EP 2530264 A1 12/2012
(Continued)

OTHER PUBLICATIONS

Search Report issued in corresponding European Patent Application No. 17886493.0 dated Apr. 17, 2020, consisting of 7 pp.
(Continued)

*Primary Examiner* — Jason D Shanske
(74) *Attorney, Agent, or Firm* — Volpe Koenig

(57) ABSTRACT

The present disclosure is related to a system for regenerating a DPF and a method thereof. The system for regenerating a DPF during operation of an engine-powered forklift that includes the DPF for collecting particulate matter form exhaust gas discharged from an engine to an exhaust path includes: an engine control unit for controlling operation of the engine; an electro-hydraulic pump for discharging a working fluid that generates a hydraulic load; a control unit for determining a state of the forklift when a DPF regeneration request signal is received from the engine control unit, and controlling at least one of the hydraulic load of the
(Continued)

electro-hydraulic pump and revolutions per minute of the engine according to the determined state of the forklift; and a diesel oxidation catalyst unit for regenerating the DPF according to the control of the control unit. According to one or more embodiments of the present invention, it is possible to regenerate a DPF in an engine-powered forklift without periodic forced regeneration of the DPF during operation of the engine-powered forklift, by controlling at least one of a load of an electro-hydraulic pump and an engine speed of an engine. Accordingly, the performance of works may be improved, and the safety may be ensured in the engine-powered forklift.

12 Claims, 4 Drawing Sheets

(51) Int. Cl.
*F01N 9/00* (2006.01)
*B66F 9/075* (2006.01)

(58) Field of Classification Search
USPC ..... 60/274
See application file for complete search history.

(56) References Cited

U.S. PATENT DOCUMENTS

2012/0247087 A1* 10/2012 Hageman ..... F02D 41/029 60/274
2012/0260633 A1* 10/2012 Masuda ..... F02D 41/0235 60/274
2012/0279203 A1* 11/2012 Arai ..... F02D 41/1448 60/276
2013/0269320 A1* 10/2013 Kwak ..... F02D 41/029 60/274
2013/0333355 A1* 12/2013 Lee ..... E02F 9/2292 60/274

FOREIGN PATENT DOCUMENTS

EP 2657476 A2 10/2013
JP 2013-108502 A 6/2013
JP 2015-175335 A 10/2015
KR 10-2012-0072745 A 7/2012
KR 10-2014-0091729 A 7/2014
KR 10-2015-0066696 A 6/2015

OTHER PUBLICATIONS

International Search Report issued in corresponding International Patent Application No. PCT/KR2017/015642 dated Apr. 16, 2018, consisting of 5 pp. (English Translation Provided).
Written Opinion issued in corresponding International Patent Application No. PCT/KR2017/015642 dated Apr. 16, 2018, consisting of 10 pp.
Office Action issued in corresponding Chinese Patent Application No. 201780081593.0 dated Feb. 1, 2021, consisting of 9 pp.

* cited by examiner

SYSTEM FOR REGENERATING DPF DURING OPERATION OF ENGINE-POWERED FORKLIFT AND METHOD THEREFOR

TECHNICAL FIELD

Embodiments of the present invention relate to a system for regenerating a diesel particulate filter (hereinafter, "DPF") during operation of an engine-powered forklift and a method thereof, and more particularly, to a system for regenerating a DPF during operation of an engine-powered forklift which is improved in performance and safety of work by controlling at least one of a load of an electro-hydraulic pump and an engine speed to regenerate the DPF, thus not requiring periodic forced regeneration of the DPF even during operation of the engine-powered forklift, and to a method thereof.

BACKGROUND ART

Generally, a forklift equipped with a diesel engine is provided with a DPF, i.e., the type of after treatment system for exhaust gas, in a path through which exhaust gas is discharged.

Since the exhaust gas includes contaminants that pollute the atmospheric environment, it must be purified before it is discharged to the atmosphere, and the above-described DPF is used as a purifier.

The exhaust gas contains carbon fine particles (soot, PM, etc.), and carbon fine particles accumulate inside the DPF. When the amount of carbon fine particles increases, the function of the DPF deteriorates. Accordingly, DPF regeneration is performed to remove such carbon fine particles when a certain amount of carbon fine particles is accumulated.

The DPF regeneration includes normal regeneration performed when a predetermined condition is satisfied and forced regeneration performed forcibly by an operator.

However, in order to for a forklift that mainly uses an engine at a low speed with a low load, it is necessary to increase the temperature of the exhaust gas through the post-fuel injection. When an engine speed is low or a load across the engine is small, the temperature of the DPF regeneration device does not rise and the natural regeneration does not occur. Accordingly, there is an inconvenience that the forklift should intermittently stop the operation and proceed with the DPF forced regeneration in order to proceed with the regeneration.

The conventional art discloses a system for regenerating a DPF that initiates the DPF regeneration system during operation of a construction machine that mainly uses a high speed engine, or a system for regenerating a DPF that generates a hydraulic load in steps according to the outside air temperature to prevent overheating of the DPF.

However, not only is it difficult to apply the conventional DPF regeneration system technique to a forklift that mainly uses an engine at a low-speed with a low load, but there is a high possibility that the engine may be overloaded and suddenly turn off, which makes it difficult to ensure the safety. In addition, the DPF regeneration system applied to conventional forklifts is limited to a case in which a traveling mode is a hydraulic pump driving type. Thus, it is difficult to be applied to engine-powered forklifts in which the traveling mode is a torque converter driving type that the power generated by the engine is controlled and the torque is automatically changed.

Accordingly, it is needed to develop a DPF regeneration system and a method thereof, which may be applied to an engine-powered forklift, which is a torque converter driven type, and which may improve work performance and ensure safety.

DETAILED DESCRIPTION OF INVENTION

Technical Problem

The embodiment of the present invention may be directed to a system for regenerating a DPF during operation of an engine-powered forklift which is improved in performance and safety of work by controlling at least one of a load of an electro-hydraulic pump and an engine speed to regenerate the DPF, thus not requiring periodic forced regeneration of the DPF even during operation of the engine-powered forklift, and to a method thereof.

Solution to Problem

According to an embodiment, a system for regenerating a DPF during operation of an engine-powered forklift that includes the DPF for collecting particulate matter form exhaust gas discharged from an engine to an exhaust path includes: an engine control unit for controlling operation of the engine; an electro-hydraulic pump for discharging a working fluid that generates a hydraulic load; a control unit for determining a state of the forklift when a DPF regeneration request signal is received from the engine control unit, and controlling at least one of the hydraulic load of the electro-hydraulic pump and revolutions per minute of the engine according to the determined state of the forklift; and a diesel oxidation catalyst unit for regenerating the DPF according to the control of the control unit.

According to an embodiment, a method for regenerating a DPF during operation of an engine-powered forklift that includes the DPF for collecting particulate matter form exhaust gas discharged from an engine to an exhaust path includes: determining a state of the forklift when a DPF regeneration request signal is received from an engine control unit; controlling at least one of a hydraulic load of an electro-hydraulic pump or revolutions per minute of the engine according to the determined state of the forklift; and regenerating the DPF by controlling at least one of the hydraulic load of the electro-hydraulic pump or the revolutions per minute of the engine.

Effects of the Invention

According to one or more embodiments of the present invention, it is possible to regenerate a DPF in an engine-powered forklift without periodic forced regeneration of the DPF during operation of the engine-powered forklift, by controlling at least one of a load of an electro-hydraulic pump and an engine speed of an engine. Accordingly, the performance of works may be improved, and the safety may be ensured in the engine-powered forklift.

In addition, according to one or more embodiments of the present invention, it is possible to regenerate a DPF during operation, even in the case of a forklift in which the traveling mode is a torque converter driven type.

In addition, according to one or more embodiments of the present invention, it is possible to regenerate a DPF during operation, since the engine speed of the engine may be increased even during a standby state of the forklift. Accordingly, it is possible to address the disadvantages of the prior art in which the regeneration operation should be interrupted periodically and DPF forced regeneration should be carried out in order to proceed with the regeneration of the forklift.

In addition, according to one or more embodiments of the present invention, since the state of the equipment is always monitored by the DPF regeneration system during the operation of the engine-powered forklift, the performance of works may be improved, and the safety may be ensured in the engine-powered forklift.

DETAILED DESCRIPTION OF EMBODIMENTS

Embodiments will now be described more fully hereinafter with reference to the accompanying drawings. The configuration, the operation and effect of the present invention will be clearly understood through the following detailed description. Before describing the present invention in detail, the same components are denoted by the same reference symbols as possible even if they are illustrated on different drawings. The detailed description of the known configuration will be omitted when it is determined that the gist of the present invention may be blurred.

The description below is merely illustrative of the present invention, and various modifications may be made by those skilled in the art without departing from the spirit of the present invention. Accordingly, the embodiments disclosed in the specification of the present invention are not intended to limit the present invention. The scope of the present invention should be construed according to the following claims, and all the techniques within the scope of equivalents should be construed as being included in the scope of the present invention.

Figure 1:
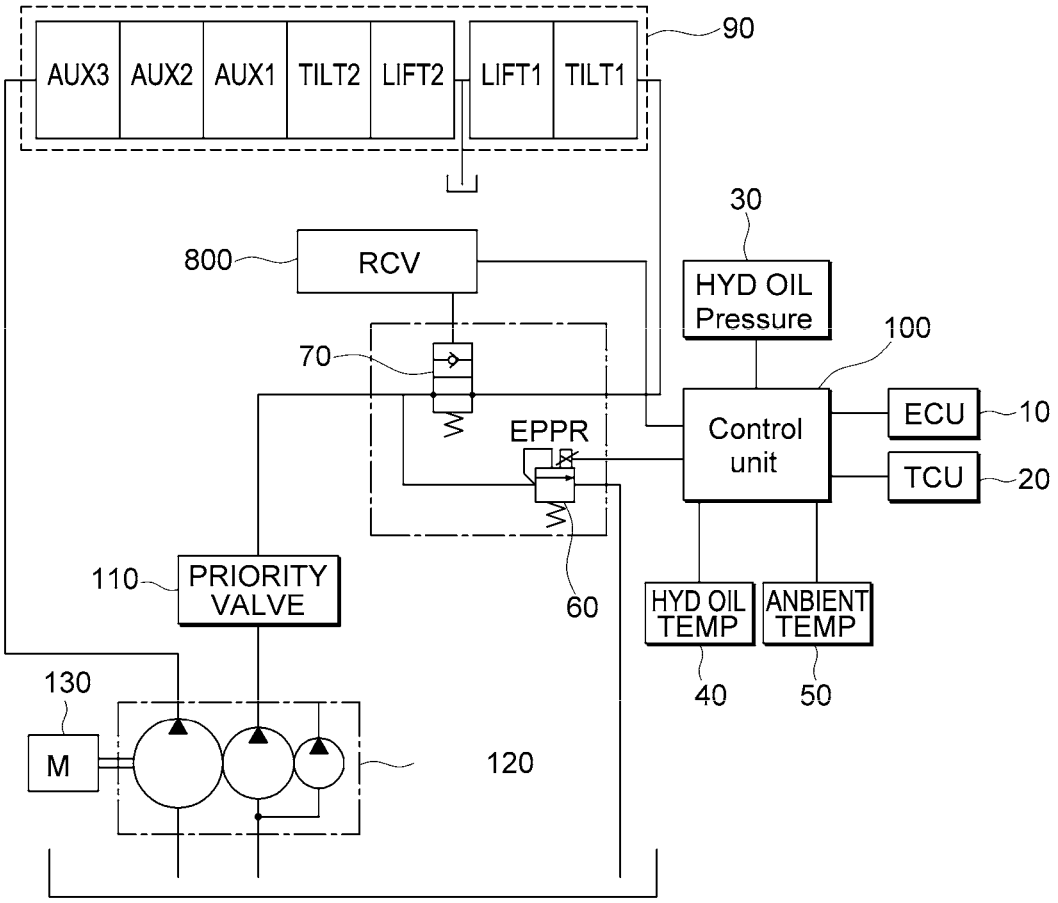
FIG. 1 is a view schematically showing a system for regenerating a DPF according to an embodiment of the present invention.

FIG. 1 is a view schematically illustrating a system for regenerating a DPF according to an embodiment of the present invention.

Referring to FIG. 1, a system for regenerating a DPF according to an embodiment includes an engine control unit (ECU) 10, a transmission control unit (TCU) 20, a fuel input means 30, temperature sensors 40 and 50, an electronic proportional control valve (EPPR) 60, an on-off solenoid valve 70, a regulation control valve (RCV) 80, a main control valve (MCV) 90, a control unit 100, a priority control valve 110, an electro-hydraulic pump 120, and a motor 130, and further includes a diesel oxidation catalyst (DOC) unit (not illustrated), a pressure sensor (not illustrated), and a memory unit (not illustrated).

The engine control unit 10 is a device that may control operation of the forklift with respect to an engine. The engine control unit 10 may adjust an output amount of the engine according to a predetermined control signal.

In an embodiment, the engine control unit 10 receives a DPF regeneration request signal from the engine, and transmits the received DPF regeneration request signal to the control unit 100. Herein, the DPF regeneration request signal is a signal for instructing DPF regeneration to eliminate carbon fine particles from a DPF that collects particulate matter (PM) from exhaust gas, which has been discharged from the engine to an exhaust path, when a certain amount of carbon fine particles or more is accumulated.

The control unit 100 may be connected to a plurality of devices constituting the forklift to control an operation of the forklift. In an embodiment, the control unit 100 may be connected to each of the engine control unit 10 and the transmission control unit 20 through an electric line, and the control unit 100 may generate a control signal and transmit it to the engine control unit 10 and the transmission control unit 20 to control the engine and the transmission.

When the control unit 100 receives the DPF regeneration request signal from the engine control unit 10 in CAN communication, the control unit 100 determines a state of the forklift. In such a case, the control unit 100 determines the state of the forklift, for example, largely, a moving state, an operation state, or a stop state. In such a case, the control unit 100 may determine the state of the forklift, e.g., a moving state, an operation state, or a stop state, by identifying positions of a parking switch, an acceleration pedal, and a gear, based on the number of revolutions (e.g., revolutions per minute (rpm), hereinafter, "engine speed (rpm)") and a vehicle speed, acquired from the engine control unit 10 and the transmission control unit 20.

The control unit 100 controls a hydraulic load of the electro-hydraulic pump 120 or an engine speed (rpm) according to the determined state of the forklift to regenerate the DPF during operation of the engine-powered forklift.

That is, when the electro-hydraulic pump 120 discharges a working fluid at a proper flow rate, as the control unit 100 controls the hydraulic load of the electro-hydraulic pump 120 or the engine speed (rpm) of the engine, the engine is overheated while working under load, and a temperature of an exhaust gas discharged from the engine is raised to a predetermined temperature, and a fuel is dosed from the fuel injection means 30 to the diesel oxidation catalyst (DOC) unit (not illustrated), located on the exhaust path, to cause an exothermic reaction between the fuel and the diesel oxidation catalyst unit. Accordingly, the exhaust gas is heated to a higher temperature, so that soot or the like trapped in the DPF (not illustrated) located at a back side than the diesel oxidation catalyst unit may be burned and removed.

The transmission control unit 20 may monitor the engine speed and a state of transmission (forward or backward).

The temperature sensors 40 and 50 may include a temperature sensor for measuring a temperature of a portion in front of the diesel oxidation catalyst unit; and a temperature sensor for measuring a temperature of an outside air. The temperature sensors 40 and 50 are used to check the possibility of overheating of the DPF. When the temperature of the outside air is high, the DPF is more likely to overheat. Accordingly, the control unit 100 generates a relatively small load to regenerate the DPF. For example, when the temperature of the portion in front of the diesel oxidation catalyst unit measured by the temperature sensor is lower than a predetermined temperature, the control unit 100 applies a control current to the electronic proportional control valve 60, and thus the temperature of the portion in front of the diesel oxidation catalyst unit may be raised to the predetermined temperature.

The on-off solenoid valve 70 is provided to control whether or not to receive and transmit the hydraulic load of the electro-hydraulic pump 120 according to the control of the control unit 100.

The electronic proportional control valve 60 may adjust an opening rate of the working fluid discharged from the electro-hydraulic pump 120 according to the control current applied from the control unit 100. For example, the electronic proportional control valve 60 is depressurized when the working fluid of a high pressure passes through, and the depressurized working fluid is supplied to the regulation control valve 80 via the on-off solenoid valve 70.

The regulation control valve 80 controls a position of a spool of the on-off solenoid valve 70 under the control of the control unit 100, thus capable of controlling the working fluid, for example, to flow in a forward direction, to flow in a reverse direction, and to stop flowing. The main control valve 90 is a valve for sending the working fluid to a working unit of the forklift, such as a tilt cylinder and a lift cylinder, and a driving unit for driving various optional units.

The priority control valve 110 distributes the working fluid discharged from the electro-hydraulic pump 120 to a traveling system and the working unit, and supplies the working fluid to the main control valve 90.

The electro-hydraulic pump 120 is connected to the engine and is driven by receiving the output of the engine. For example, a swash plate angle is adjusted through a regulator such as the electronic proportional control valve 60 to adjust a flow rate to be discharged.

The motor 130 may drive the electro-hydraulic pump 120, the diesel oxidation catalyst unit (not illustrated) may regenerate the DPF, and a pressure sensor (not illustrated) may measure the hydraulic load that is generated by the working fluid discharged from the electro-hydraulic pump.

A memory unit (not illustrated) stores a predetermined hydraulic load value, a predetermined temperature of the portion in front of the diesel oxidation catalyst unit, a predetermined engine speed (rpm), and a predetermined engine load factor, so that the control unit 100 may compare them with measurement values.

The specific operation of the control unit 100 will be described below with reference to FIG. 3

Figure 2:
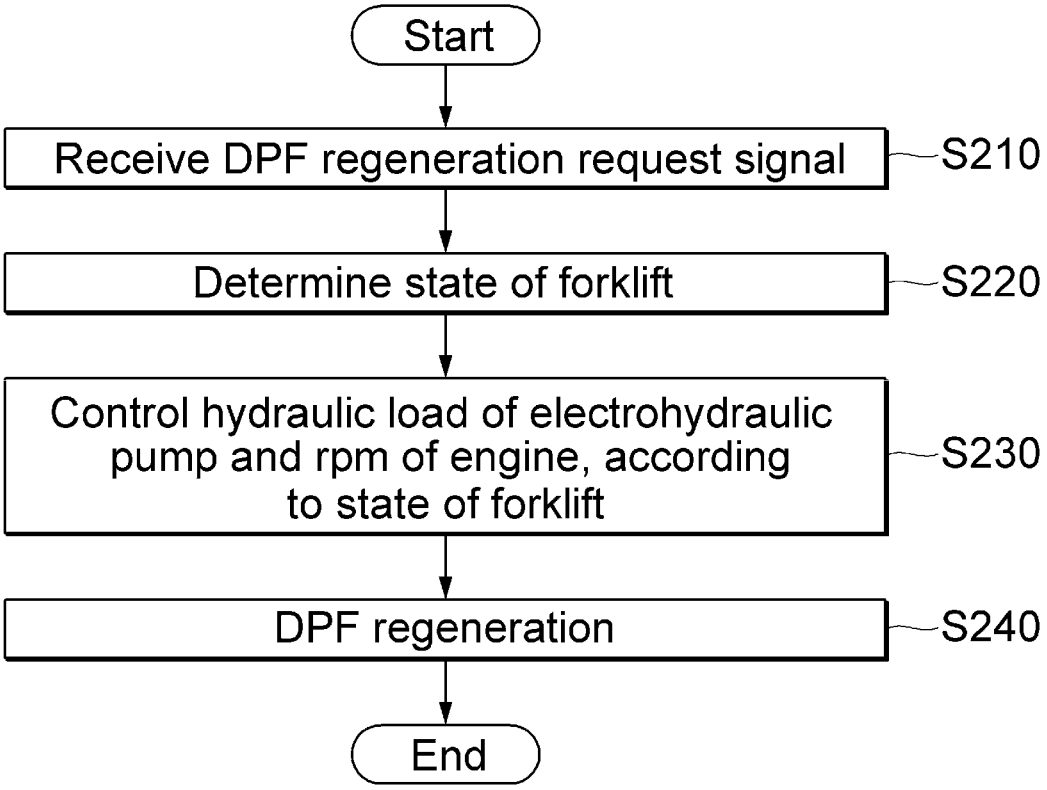
FIG. 2 is a flowchart schematically illustrating a method for regenerating a DPF according to an embodiment of the present invention.

FIG. 2 is a flowchart schematically illustrating a method for regenerating a DPF according to an embodiment of the present invention.

As illustrated in FIG. 2, a method for regenerating a DPF according to an embodiment largely includes: receiving a DPF regeneration request signal from the engine control unit (S210), determining the state of the forklift (S220), controlling the hydraulic load of the electro-hydraulic pump or the engine speed (rpm) according to the determined state of the forklift (S230), and regenerating the DPF by controlling the hydraulic load of the electro-hydraulic pump or the engine speed (rpm) (S240).

Figure 3:
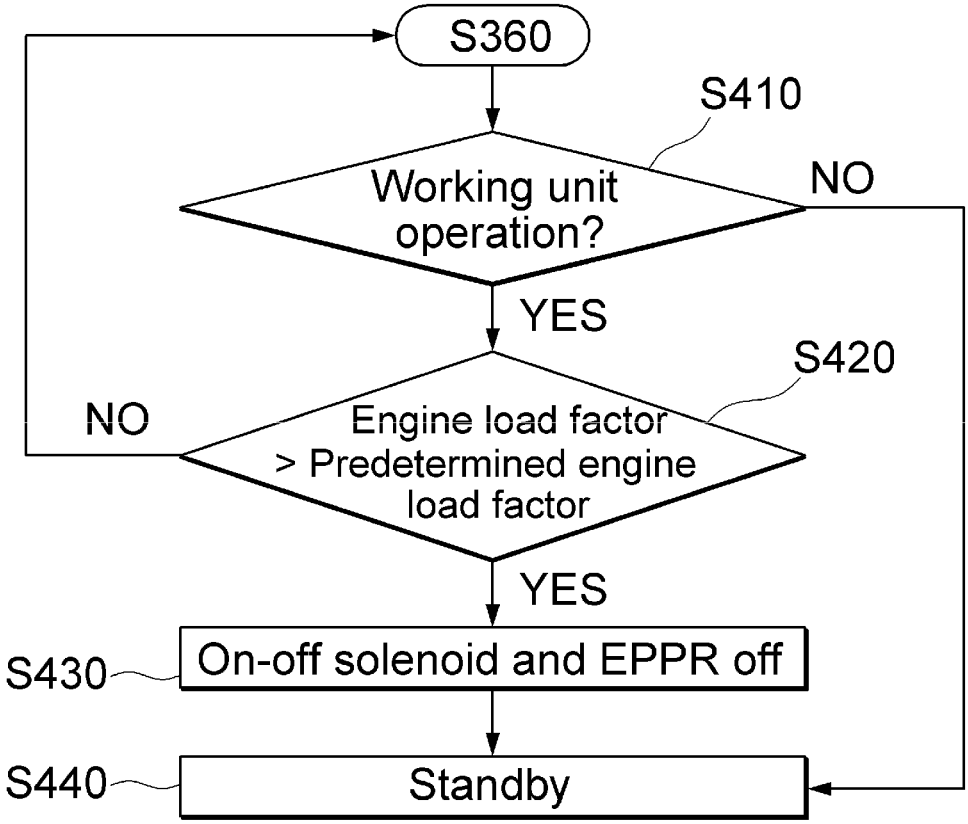
FIG. 3 is a flowchart specifically illustrating an operation of a DPF regeneration system in a method for regenerating a DPF according to an embodiment of the present invention.

FIG. 3 is a flowchart specifically illustrating an operation of a system for regenerating a DPF in a DPF regeneration method according to an embodiment of the present invention.

In step S310, the control unit 100 receives a DPF regeneration request signal from the engine control unit. The DPF regeneration request signal is a signal for instructing DPF regeneration to eliminate carbon fine particles from the DPF that collects particulate matter (PM) from exhaust gas, which has been discharged from the engine to the exhaust path, when a certain amount of carbon fine particles or more is accumulated.

In step S320, the control unit 100 determines the state of the forklift. In such a case, the control unit 100 may determine the state of the forklift, e.g., a moving state, an operation state, or a stop state, by identifying positions of a parking switch, an acceleration pedal, and a gear. For example, when at least one of conditions of an off state of the parking switch, an on state of the acceleration pedal, and a forward (F) or reverse (R) state of the gear, the control unit 100 determines that the forklift is in the moving state or the operation state, and the process proceeds to step S330. Otherwise, the process proceeds to step S380.

In step S330, the control unit 100 compares a value of the hydraulic load, generated by the electro-hydraulic pump 120, measured by the pressure sensor (not illustrated), with the predetermined hydraulic load value stored in the memory unit (not illustrated). In a case where the value of the hydraulic load generated at the electro-hydraulic pump 120 is less than the predetermined hydraulic load value stored in the memory unit (not illustrated), the process proceeds to step S340.

In step S340, the control unit 100 may increase the hydraulic load by applying a load to the electro-hydraulic pump 120 by turning on the on-off solenoid valve 70.

Thereafter, in step S350, the control unit 100 compares the temperature of the portion in front of the diesel oxidation catalyst unit, measured by the temperature sensor 40, with the predetermined temperature stored in the memory unit (not illustrated), in a state where the on-off solenoid valve 70 is turned on. In a case where the temperature of the portion in front of the diesel oxidation catalyst unit, measured by the temperature sensor 40, is less than the predetermined temperature stored in the memory unit (not illustrated), the process proceeds to step S360.

In step S360, the control unit 100 applies a control current to the electronic proportional control valve 60 to raise the temperature of the portion in front of the diesel oxidation catalyst unit to the predetermined temperature stored in the memory unit (not illustrated). In such a case, the control unit 100 may adjust the working fluid to be discharged from the electro-hydraulic pump 120 at a flow rate in five steps by applying the control current to the electronic proportional control valve 60 in five steps.

In step S370, the control unit 100 monitors whether the temperature of the portion in front of the diesel oxidation catalyst unit, measured by the temperature sensor 40, is the predetermined temperature stored in the memory unit (not illustrated) or higher. Based on the monitoring result, in a case where the temperature of the portion in front of the diesel oxidation catalyst unit, measured by the temperature sensor 40, is the predetermined temperature stored in the memory unit (not illustrated) or higher, the process proceeds to a standby state to substantially prevent the DPF from overheating.

As described above, when it is determined that the forklift is in the moving state or the operation state, the control unit 100 may adjust the hydraulic load of the electro-hydraulic pump 120 by controlling the on-off solenoid valve 70 and the electronic proportional control valve 60, without controlling the engine speed (rpm).

On the contrary to the above, in a case where the control unit 100 determines in step S320 that the forklift is in a stop state, the process proceeds to step S380. More specifically, in step S320, the control unit identifies positions of the parking switch, the acceleration pedal, and the gear. In such a case, when all the conditions of an on state of the parking switch, an off state of the acceleration pedal, and a neutral N state of the gear position, the control unit 100 determines that the forklift is in the stop state.

Thereafter, in step S390, the control unit 100 may raise the engine speed (rpm) to the predetermined engine speed (rpm) stored in the memory unit (not illustrated) by controlling the transmission control unit 20. In such a case the forklift is in the standby state.

Thereafter, in step S400, the control unit 100 determines whether the forklift is in the operation state or the moving state. In a case where the control unit 100 determines that the forklift is switched to the moving state or the operation state as a result of the determination, the control unit 100 may apply a signal for reducing the engine speed (rpm) to the transmission control unit 20.

Next, in step S410, the control unit 100 determines whether the engine speed (rpm) is greater than the predetermined engine speed (rpm) stored in the memory unit (not illustrated) in a state where the forklift is switched to the moving state or the operation state. In a case where the engine speed (rpm) of the engine is greater than the predetermined engine speed (rpm) stored in the memory unit (not illustrated) in a state where the forklift is switched to the moving state or the operation state, the process proceeds to step S420, and the control unit 100 applies a neutral N request signal for maintaining the neutral N state to the transmission control unit 20. Thus, the process proceeds to the standby state.

On the other hand, based on the determination of the control unit 100 in step S410, in a case where the engine speed (rpm) is less than the predetermined engine speed (rpm) stored in the memory unit (not illustrated) in a state where the forklift is switched to the moving state or the operation state, the process proceeds to step S430, and the control unit 100 cancels application of the neutral N request signal for maintaining the neutral N state to the transmission control unit 20. Thus, the process proceeds back to step S310.

That is, the process from step S380 to step S410 according to an embodiment of the present invention relates to a control logic for the forklift in a standby state. Although the forklift is in the standby state, the engine speed (rpm) may b raised up to the predetermined engine speed (rpm) stored in the memory unit (not illustrated), thus allowing DPF regeneration even during operation.

Figure 4:
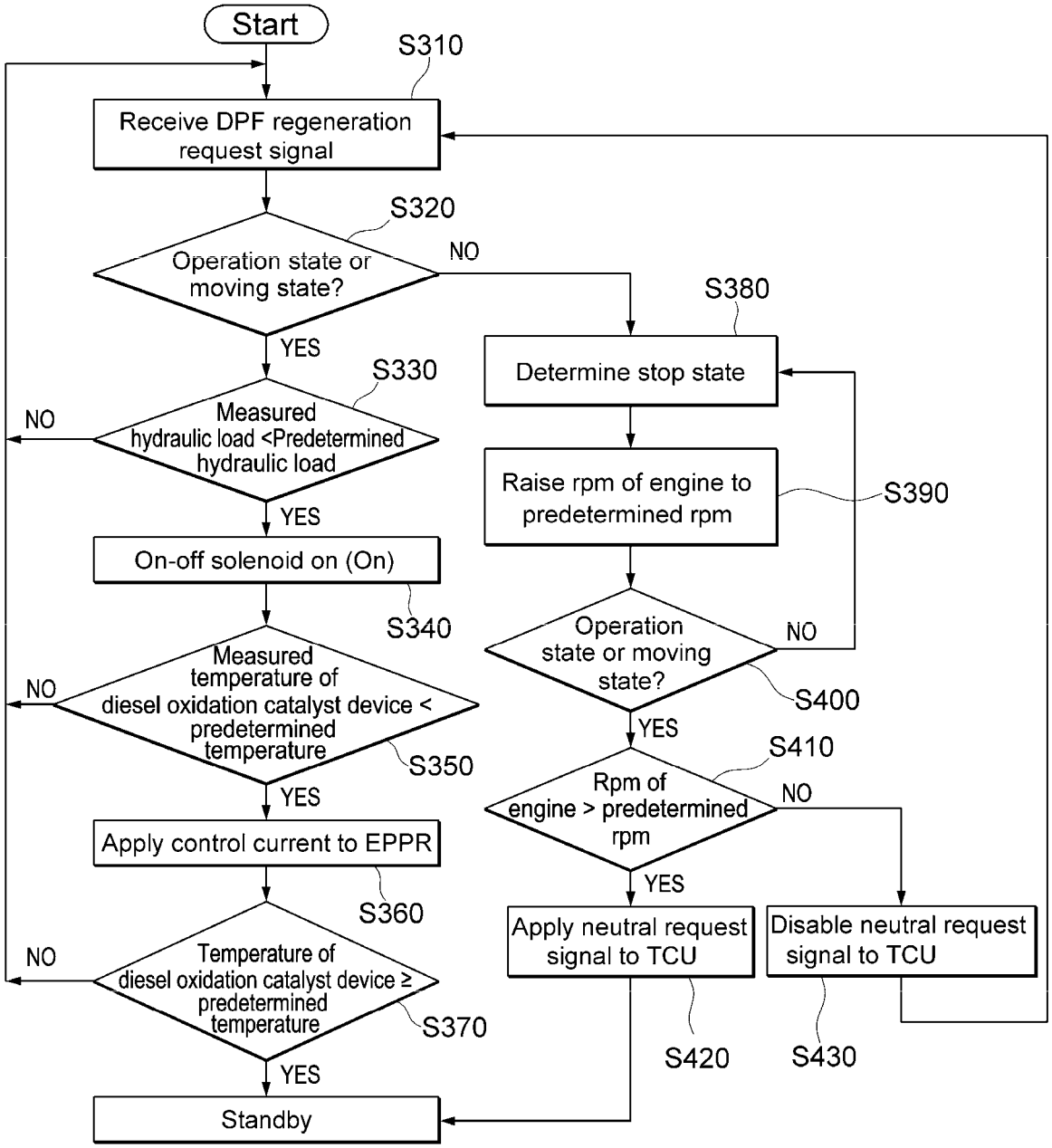
FIG. 4 is a flowchart illustrating an embodiment of a control logic for preventing an engine from being turned off due to an overload in a method for regenerating a DPF according to an embodiment of the present invention.

FIG. 4 is a flowchart illustrating an embodiment of a control logic for preventing an engine from being turned off due to an overload in a DPF regeneration method according to an embodiment of the present invention. The process before step S360 in FIG. 4 is the same as the process from step S310 to step S360 in FIG. 3, and thus description thereof will be omitted.

In step S360, as a result of the control of the control unit 100 in steps S310 to S360 in FIG. 3, the on-off solenoid valve 70 and the electronic proportional control valve 60 are in an on state.

Thereafter, in step S410, the control unit 100 determines whether the working unit is operating, in a state that the on-off solenoid valve 70 and the electronic proportional control valve 60 are in the on state. In such a case, if it is determined by the control unit 100 that the working unit is operating, the process proceeds to step S420; otherwise, the process proceeds to step S440.

In step S420, the control unit 100 compares an engine load factor based on the operation of the working unit with the predetermined engine load factor stored in the memory unit (not illustrated). As a result of the comparison, in a case where the engine load factor based on the operation of the working unit exceeds the predetermined engine load factor (for example, about 80%) stored in the memory unit (not illustrated), the process proceeds to step S430 and step S440 to set the on-off solenoid valve 70 and the electronic proportional control valve 60 to an off state, and the process proceeds to the standby state.

On the other hand, in a case where the engine load factor based on the operation of the working unit is substantially equal to or less than the predetermined engine load factor (for example, about 80%) stored in the memory unit (not illustrated) as a result of the comparison in S420, the control unit 100 controls the on-off solenoid valve 70 and the electronic proportional control valve 60 back to an on state.

As the working unit of the forklift operates according to the control logic described above, it is possible to substantially prevent an engine stall phenomenon in which the engine suffers a large load and suddenly stops working, regardless of the intention of the operator.

The foregoing description is merely illustrative of the present invention, and various modifications may be made by those skilled in the art without departing from the spirit of the present invention. Accordingly, the embodiments disclosed in the specification of the present invention are not intended to limit the present invention. The scope of the present invention should be construed according to the following claims, and all the techniques within the scope of equivalents should be construed as being included in the scope of the present invention.

The invention claimed is:

1. A system for regenerating a diesel particulate filter (DPF) during operation of an engine-powered forklift that comprises the DPF for collecting particulate matter from exhaust gas discharged from an engine to an exhaust path, the system comprising:

an engine controller configured to control operation of the engine;

an electro-hydraulic pump for discharging a working fluid that generates a hydraulic load;

a DPF controller configured to determine a state of the forklift when a DPF regeneration request signal is received from the engine controller, and to control at least one of hydraulic load of the electro-hydraulic pump and revolutions per minute of the engine according to the determined state of the forklift;

a diesel oxidation catalyst unit for regenerating the DPF according to the control of the DPF controller; and a pressure sensor for measuring the hydraulic load generated by the working fluid discharged from the electro-hydraulic pump;

wherein, in order to increase a temperature of the exhaust gas to allow the regeneration of the DPF, the DPF controller is configured to increase the number of revolutions of the engine when the forklift is in a stop state, and control the hydraulic load of the electro-hydraulic pump based on a result of comparing a value of the hydraulic load, generated at the electro-hydraulic pump, measured by the pressure sensor, with a predetermined hydraulic load value when the forklift is in a moving state or an operation state; and wherein, when the forklift is in a stop state having the revolutions per minute of the engine increased to regenerate the DPF, when it is determined that the state of the forklift is switched to a moving state or an operation state, the controller is configured to decrease the revolutions per minute of the engine to a predetermined revolutions per minute of the engine.

2. The system for regenerating a DPF of claim 1, further comprising:

a transmission controller configured to control transmission of the forklift;

an on-off solenoid valve for controlling whether or not to receive and transmit the hydraulic load of the electro-hydraulic pump;

an electronic proportional control valve for controlling an opening ratio according to a control current applied from the DPF controller; and a temperature sensor for measuring a temperature of a portion in front of the diesel oxidation catalyst unit.

3. The system for regenerating a DPF of claim 2, wherein when it is determined that the state of the forklift is in a moving state or an operation state, the DPF controller compares a value of the hydraulic load, generated at the electro-hydraulic pump, measured by the pressure sensor, with a predetermined hydraulic load value, and when the value of the hydraulic load generated at the electro-hydraulic pump is less than the predetermined hydraulic load value, the DPF controller turns on the on-off solenoid valve to increase the hydraulic load by applying a load to the electro-hydraulic pump.

4. The system for regenerating a DPF of claim 3, wherein the DPF controller compares the temperature of the portion in front of the diesel oxidation catalyst unit, measured by the temperature sensor, with a predetermined temperature, in a state where the on-off solenoid valve is in an on state, and when the temperature of the portion in front of the diesel oxidation catalyst unit, measured by the temperature sensor, is lower than the predetermined temperature, DPF controller raises the temperature of the portion in front of the diesel oxidation catalyst unit to the predetermined temperature by applying a control current to the electronic proportional control valve.

5. The system for regenerating a DPF of claim 3, wherein when the value of the hydraulic load, generated at the electro-hydraulic pump, measured by the pressure sensor, is greater than the predetermined hydraulic load value, the DPF controller controls the revolutions per minute of the engine to be increased to a predetermined revolutions per minute of the engine.

6. The system for regenerating a DPF of claim 4, wherein when an actuator of the forklift operates in a state where the on-off solenoid valve and the electronic proportional control valve are in an on state, the DPF controller determines whether an engine load factor measured by the engine controller exceeds a predetermined engine load factor, and when the engine load factor measured by the engine controller exceeds the predetermined engine load factor based on the determination, the DPF controller controls the on-off solenoid valve and the electronic proportional control valve to an off state, thereby preventing the engine from being turned off due to an overload.

7. A method for regenerating a DPF during operation of an engine-powered forklift that comprises the DPF for collecting particulate matter from exhaust gas discharged from an engine to an exhaust path, the method comprising:

determining a state of the forklift when a DPF regeneration request signal is received from an engine controller;

controlling at least one of hydraulic load of an electro-hydraulic pump or revolutions per minute of the engine according to the determined state of the forklift; and regenerating the DPF by controlling at least one of the hydraulic load of the electro-hydraulic pump or the revolutions per minute of the engine, wherein, in order to increase a temperature of the exhaust gas to allow the regeneration of the DPF, the regenerating the DPF by controlling at least one of the hydraulic load of the electro-hydraulic pump or the revolutions per minute of the engine is by:

increasing the revolutions per minute of the engine when the state of the forklift is the stop state, and controlling the hydraulic load of the electro-hydraulic pump when the forklift is in a moving state or an operation state, wherein, when the forklift is in a stop state having the revolutions per minute of the engine increased to regenerate the DPF, when it is determined that the state of the forklift is switched to a moving state or an operation state, the number of revolutions of the engine is decreased to a predetermined revolutions per minute of the engine.

8. The method of claim 7, wherein determining of the state of the forklift when the DPF regeneration request signal is received from the engine controller is:

determining whether the state of the forklift is a moving state, an operation state, or a stop state.

9. The method of claim 8, wherein controlling of at least one of the hydraulic load of the electro-hydraulic pump or the revolutions per minute of the engine according to the determined state of the forklift comprises:

comparing a value of the hydraulic load, generated at the electro-hydraulic pump, measured by a pressure sensor, with a predetermined hydraulic load value, when it is determined that the state of the forklift is the moving state or the operation state; and increasing the hydraulic load by turning on the on-off solenoid valve to apply a load to the electro-hydraulic pump, when the value of the hydraulic load generated at the electro-hydraulic pump is less than the predetermined hydraulic load value.

10. The method of claim 9, further comprising:

comparing a temperature of a portion in front of the diesel oxidation catalyst unit, measured by a temperature sensor, with a predetermined temperature, in a state where the on-off solenoid valve is in an on state; and raising the temperature of the portion in front of the diesel oxidation catalyst unit to the predetermined temperature by applying a control current to the electronic proportional control valve, when the temperature of the portion in front of the diesel oxidation catalyst unit measured by the temperature sensor is less than the predetermined temperature.

11. The method of claim 9, further comprising:

controlling the revolutions per minute of the engine to be raised to a predetermined revolutions per minute of the engine, when the value of the hydraulic load generated at the electro-hydraulic pump is greater than the predetermined hydraulic load value.

12. The method of claim 10, further comprising:

determining whether an engine load factor measured by the engine controller exceeds a predetermined engine load factor, when a working unit of the forklift operates in a state where the on-off solenoid valve and the electronic proportional control valve are in an on state; and controlling, when the engine load factor measured by the engine controller exceeds the predetermined engine load factor based on the determination, the on-off solenoid valve and the electronic proportional control valve to an off state, thereby preventing the engine from being turned off due to an overload.

* * * * *